US007699092B2

(12) United States Patent
Czerwinski

(10) Patent No.: US 7,699,092 B2
(45) Date of Patent: Apr. 20, 2010

(54) METAL-MOLDING SYSTEM AND PROCESS FOR MAKING FOAMED ALLOY

(75) Inventor: Frank Czerwinski, Bolton (CA)

(73) Assignee: Husky Injection Molding Systems Ltd., Bolton ON (CA)

( * ) Notice: Subject to any disclaimer, the term of this patent is extended or adjusted under 35 U.S.C. 154(b) by 513 days.

(21) Appl. No.: 11/764,240

(22) Filed: Jun. 18, 2007

(65) Prior Publication Data

US 2008/0311418 A1 Dec. 18, 2008

(51) Int. Cl.
*B22D 27/00* (2006.01)
*B22D 17/00* (2006.01)

(52) U.S. Cl. ..... 164/79; 164/113; 164/312

(58) Field of Classification Search ..... 164/79, 164/113, 312; 75/415
See application file for complete search history.

(56) References Cited

U.S. PATENT DOCUMENTS

| | | | |
|---|---|---|---|
| 5,865,237 | A | 2/1999 | Schorghuber et al. |
| 5,972,285 | A | 10/1999 | Knott |
| 6,733,722 | B2 | 5/2004 | Singer et al. |
| 6,759,004 | B1 | 7/2004 | Dwivedi |
| 6,840,301 | B2 | 1/2005 | Nichol et al. |
| 6,866,084 | B2 | 3/2005 | Asholt et al. |
| 6,915,834 | B2 | 7/2005 | Knott et al. |
| 6,998,535 | B2 | 2/2006 | Nichol |
| 7,175,689 | B2 | 2/2007 | Dobesberger et al. |
| 7,195,662 | B2 | 3/2007 | Dobesberger et al. |
| 2006/0000572 | A1 * | 1/2006 | Tanaka et al. ..... 164/79 |
| 2006/0006563 | A1 | 1/2006 | Serniuck et al. |
| 2006/0096733 | A1 | 5/2006 | Czerwinski |

FOREIGN PATENT DOCUMENTS

| | | | |
|---|---|---|---|
| DE | 19746164 | A1 | 4/1999 |
| WO | 2004108976 | A2 | 12/2004 |
| WO | 2006021082 | | 3/2006 |

OTHER PUBLICATIONS

Frantiek Simancik, Metallic Foams-Ultra Light Materials for Structural Applications, Technical Journal, Inzynieria Materialowa Nr. May 2001, pp. 823-828.

Fr.-W. Bach, O. Bormaun, P. Wilk, R. Kucharski, Production and Properties of Foamed Magnesium, Cellular Metals and Polymers 2004, edited by R.F. Singer; C. Korner, V. Altstadt, Fragezeichenverlag, Furth, Long ISBN No. 8585858585, pp. 77 to 80.

* cited by examiner

*Primary Examiner*—Kevin P Kerns
(74) *Attorney, Agent, or Firm*—Husky Intellectual Property Services

(57) ABSTRACT

Disclosed is: (i) a metal injection-molding system, (ii) a metal injection-molding system including a combining chamber, (iii) a metal injection-molding system including a first injection mechanism and a second injection mechanism, (iv) a metal injection-molding system including a first injection mechanism being co-operable with a second injection mechanism, (v) a mold of a metal injection-molding system, and (vi) a method of a metal injection-molding system.

14 Claims, 9 Drawing Sheets

METAL-MOLDING SYSTEM AND PROCESS FOR MAKING FOAMED ALLOY

TECHNICAL FIELD

The present invention generally relates to, but is not limited to, molding systems, and more specifically the present invention relates to, but is not limited to, (i) a metal injection-molding system, (ii) a metal injection-molding system including a combining chamber, (iii) a metal injection-molding system including a first injection mechanism and a second injection mechanism, (iv) a metal injection-molding system including a first injection mechanism being co-operable with a second injection mechanism, (v) a mold of a metal injection-molding system, and (vi) a method of a metal injection-molding system.

BACKGROUND

Examples of known molding systems are (amongst others): (i) the HyPET™ Molding System, (ii) the Quadloc™ Molding System, (iii) the Hylectric™ Molding System, and (iv) the HyMet™ Molding System, all manufactured by Husky Injection Molding Systems Limited (Location: Bolton, Ontario, Canada; www.husky.ca).

U.S. Pat. No. 5,865,237 (Inventor: SCHORGHUBER et al; Published: 1999, Feb. 2) discloses production of molded foamed metal parts, in which a compacted powder metallurgical preform is foamed by heating in a chamber and the foam charge is injected into a mold.

U.S. Pat. No. 5,972,285 (Inventor: KNOTT; Published: 1999, Oct. 26) discloses a foamed metal especially aluminum body production from a compacted mixture of metal powder and magnesium hydride blowing agent.

U.S. Pat. No. 6,733,722 (Inventor: SINGER et al; Published: 2004, May 11) discloses production of a molded body from a foamed metal that includes feeding two powders in non-compact form to an extruder, injecting powder mixture into the mold and releasing the pressure so that the mold is completely filled with foamed metal.

PCT Patent Number WO/04108976A2 (Inventor: KÖRNER et al; Published: 2004, Dec. 16) discloses foamed metal molding production, that includes adding foaming agent to molten metal after leaving supply vessel and before entry into a mold cavity. Also disclosed is a method for producing a metal foam body, whereby a molten metal is prepared and introduced into a reservoir, and the molten metal is injected into a mold cavity surrounded by a mold, via a line connecting the reservoir to the mold. The aim is to create a foam structure only in the core of the metal foam body. To this end, a blowing agent is added to the metal melt, once it has left the reservoir and before it enters the mold cavity.

U.S. Pat. No. 6,866,084 (Inventor: ASHOLT et al; Published: 2005, Mar. 15) discloses a method and means for producing molded bodies of a metal foam, in particular an aluminum foam. The method involves the use of mold having a cavity and at least one entrance opening. The mold is filled with a metal foam in a manner where the entrance opening of the mold is submerged into a metal melt and the melt is caused to foam inside the mold and fill its cavity.

U.S. Pat. No. 6,840,301 (Inventor: NICHOL et al; Published: 2005, Jan. 11) discloses aluminum article casting that involves releasing pressure in a bath, after filling a molten aluminum foam produced by passing gas bubbles through the molten aluminum, to remove the article from the die cavity.

U.S. Pat. No. 6,915,834 (Inventor: KNOTT et al; Published: 2005, Jul. 12) discloses production of a metal foam that includes inserting the molten metal into a mold hollow chamber, and foaming with a propellant which is solid at room temperature. Also disclosed is a process for producing a metal foam and to a metal body produced using the process. The object is achieved by a process for producing the metal foam by adding a blowing agent to a metal melt, wherein the metal melt is: (i) introduced into the die cavity of a metal die-casting machine, and is (ii) foamed using a blowing agent, which releases gases and is solid at room temperature.

U.S. Pat. No. 6,998,535 (Inventor: NICHOL; Published: 2006, Feb. 14) discloses a method for casting articles from a metal foam, a molten metal bath and a foam-forming means. The foam is drawn into a ladle, within a heated chamber, which transports a foam sample to a mold. The ladle deposits the foam sample into the mold and the mold is closed. Once cooled and hardened the formed article is removed. The system includes a molten metal bath, a heated foam collecting chamber, a ladle for drawing a sample of the foam and for transporting the sample to a mold.

PCT Patent Application Number WO/06021082 (Inventor: KILLINGBECK et al; Published: 2006, May 04) discloses a casting apparatus for casting metal foam article from foam of molten metal. The apparatus includes a gas injection nozzle connected to a gas supply. The nozzle is positioned below a mold cavity opening. A flow generating mechanism causes a molten metal to flow.

U.S. Pat. No. 7,175,689 (Inventor: DOBESBERGER et al; Published: 2007, Feb. 13) discloses a process for producing a lightweight molded part, comprising introducing a gas into a particle-containing, molten metal to produce a metal foam having voids with a monomodal distribution of their dimensions, introducing the metal foam into a casting die and compressing it therein essentially under all-round pressure; and the molded part made by this process.

U.S. Pat. No. 7,195,662 (Inventor: DOBESBERGER et al; Published: 2007, Mar. 27) discloses a device for feeding gas in a melt of foamable metal by means of at least one pipe for producing metal foam. The gas insertion pipe projects inwardly into the melt and at the projecting end has a gas outlet having a cross-sectional area of 0.006 to 0.2 millimeters (mm) squared, and a pipe face area of less than 4.0 mm squared. A flowable metal foam has gas bubbles defined by walls of a liquid metal matrix with solid reinforcing particles, and the diameter of the largest gas bubbles divided by that of the smallest gas bubbles is less than 2.5.

A technical article (Title: METALLIC FOAMS—ULTRA LIGHT MATERIALS FOR STRUCTURAL APPLICATIONS; Author: FRANTIEK SIMANCIK; Technical Journal Name: INZYNIERIA MATERIALOWA Nr. 5/2001; Pages: 823 to 828) discloses, in the Abstract, the following: metallic foams are relatively unknown structural materials, however with enormous future potential for applications where lightweight combined with high stiffness and acceptable manufacturing costs are of prime interest The performance of metallic foams, in particular those made of aluminum, in various prototypes, such as foamed panels, sandwiches, complex 3-D-parts, foamed hollow profiles as well as castings with foamed cores, has been discussed with respect to the expected and achieved goals. The important contributions of aluminum foam to the improvement of the products properties are highlighted and most promising utilization is suggested.

A technical article (Title: PRODUCTION AND PROPERTIES OF FOAMED MAGNESIUM; Authors: Fr.-W. BACH, 0. BORMAUN, P. WILK, R. KUCHARSKI; Journal Title: CELLULAR METALS AND POLYMERS 2004, pages 77 to 80, edited by R. F. Singer; C. Körner, V. Altstadt, Fragezeichenverlag, Furth, Long ISBN number 8585858585) discloses, in the Abstract, results from the priority program "Cellular Metals" of the Deutsche Forschungsgemeinschaft (DFG SPP 1075). Two processes for the production of foams and sponges basing on magnesium are presented and discussed concerning their producibility and their applications. The powder metallurgical route for the production of metallic foams basing on aluminum is well examined since some decades but foamed parts basing on magnesium could not be produced yet. The discussion of the foamability of magnesium alloys leads to a sintering process which enhances the foamability at the beginning of the foaming process and finally leads to foamed magnesium cylinders with 40 mm in diameter. Relatively easy in the production but appropriate only for small open cell sponges is the infiltration process using salt grains as place holder. The molten magnesium is forced by vacuum to infiltrate the salt grains which are dissolved in sodium hydroxide solution after machining. A method which applies mechanical vibration for grain fining of the bulk material and improving the infiltration process is adopted.

SUMMARY

According to a first aspect of the present invention, there is provided a metal injection-molding system, including a combining chamber configured to: (i) receive a molten-metallic alloy and a spacing agent being injectable under pressure into the combining chamber, the molten-metallic alloy and the spacing agent combinable, at least in part, under pressure in the combining chamber, and (ii) convey, under pressure, the molten-metallic alloy and the spacing agent toward a mold, the molten-metallic alloy combined with the spacing agent being solidifiably formable into a molded-foamed-metallic article in the mold.

According to a second aspect of the present invention, there is provided a metal injection-molding system, including a first injection mechanism configured to process a molten-metallic alloy, and a second injection mechanism configured to process a spacing agent, the first injection mechanism and the second injection mechanism configured to couple to a combining chamber configured to: (i) receive a molten-metallic alloy and a spacing agent being injectable under pressure into the combining chamber, the molten-metallic alloy and the spacing agent combining, at least in part, under pressure in the combining chamber, and (ii) convey, under pressure, the molten-metallic alloy and the spacing agent to a mold, the molten-metallic alloy combined with the spacing agent being solidifiably formable into a molded-foamed-metallic article in the mold.

According to a third aspect of the present invention, there is provided a metal injection-molding system, including a first injection mechanism configured to process a molten-metallic alloy, the first injection mechanism being co-operable with a second injection mechanism configured to process a spacing agent, the first injection mechanism and the second injection mechanism configured to couple to a combining chamber configured to: (i) receive a molten-metallic alloy and a spacing agent being injectable under pressure into the combining chamber, the molten-metallic alloy and the spacing agent combining, at least in part, under pressure in the combining chamber, and (ii) convey, under pressure, the molten-metallic alloy and the spacing agent to a mold, the molten-metallic alloy combined with the spacing agent being solidifiably formable into a molded-foamed-metallic article in the mold.

According to a fourth aspect of the present invention, there is provided a metal injection-molding system, including a first injection mechanism configured to process a molten-metallic alloy, a second injection mechanism configured to process a spacing agent, a stationary platen configured to support a stationary mold portion of a mold, a movable platen configured to move relative to the stationary platen, and configured to support a movable mold portion of the mold, the stationary mold portion and the movable mold portion forming a mold cavity once the movable platen is made to move toward the stationary platen sufficiently enough as to abut the stationary mold portion against the movable mold portion, the stationary mold portion defining a mold gate leading to the mold cavity, a clamping mechanism coupled to the stationary platen and the movable platen, and configured to apply a clamp tonnage between the stationary platen and the movable platen, and a combining chamber configured to: (i) receive a molten-metallic alloy and a spacing agent being injectable under pressure into the combining chamber, the molten-metallic alloy and the spacing agent combining, at least in part, under pressure in the combining chamber, and (ii) convey, under pressure, the molten-metallic alloy and the spacing agent to a mold, the molten-metallic alloy combined with the spacing agent being solidifiably formable into a molded-foamed-metallic article in the mold.

According to a fifth aspect of the present invention, there is provided a method of a metal injection-molding system, including: (i) receiving, in a combining chamber, a molten-metallic alloy and a spacing agent being injectable under pressure into the combining chamber, the molten-metallic alloy and the spacing agent combining, at least in part, under pressure in the combining chamber, and (ii) conveying, under pressure, the molten-metallic alloy and the spacing agent to a mold, the molten-metallic alloy combined with the spacing agent being solidifiably formable into a molded-foamed-metallic article in the mold.

According to a sixth aspect of the present invention, there is provided a metal injection-molding process, including injecting, under pressure, a molten-metallic alloy and a spacing agent into a mold, the molten-metallic alloy combined with the spacing agent being solidifiably formable into a molded-foamed-metallic article in the mold.

According to a seventh aspect of the present invention, there is provided a metal injection-molding process, including: (i) a receiving operation, including receiving a solidified molten-metallic alloy and a spacing agent, (ii) a heating operation, including heating the solidified molten-metallic alloy associated with the receiving operation above a solidus temperature of the solidified molten-metallic alloy, the solidified molten-metallic alloy becoming a molten-metallic alloy, (iii) a combining operation, including combining the molten-metallic alloy associated with the heating operation with the spacing agent associated with the receiving operation, and (iv) an injecting operation, including injecting, under pressure, the molten-metallic alloy and the spacing agent into a mold, the molten-metallic alloy combined with the spacing agent being solidifiably formable into a molded-foamed-metallic article in the mold.

According to an eighth aspect of the present invention, there is provided a metal injection-molding system, including: (i) receiving means configured to implement a receiving operation, including receiving a solidified molten-metallic alloy and a spacing agent, (ii) heating means configured to implement a heating operation, including heating the solidified molten-metallic alloy associated with the receiving operation above a solidus temperature of the solidified molten-metallic alloy, the solidified molten-metallic alloy becoming a molten-metallic alloy, (iii) combining means configured to implement a combining operation, including combining the molten-metallic alloy associated with the heating operation with the spacing agent associated with the receiving operation, and (iv) injection means configured to implement an injecting operation, including injecting, under pressure, the molten-metallic alloy and the spacing agent into a mold, the molten-metallic alloy and the spacing agent into a mold, the molten-metallic alloy combined with the spacing agent being solidifiably formable into a molded-foamed-metallic article in the mold.

A technical effect, amongst other technical effects, of the aspects of the present invention is improved operation of a molding system for manufacturing articles molded of metallic alloys.

DESCRIPTION OF THE DRAWINGS

A better understanding of the non-limiting embodiments of the present invention (including alternatives and/or variations thereof) may be obtained with reference to the detailed description of the non-limiting embodiments along with the following drawings, in which.

Figure 1:
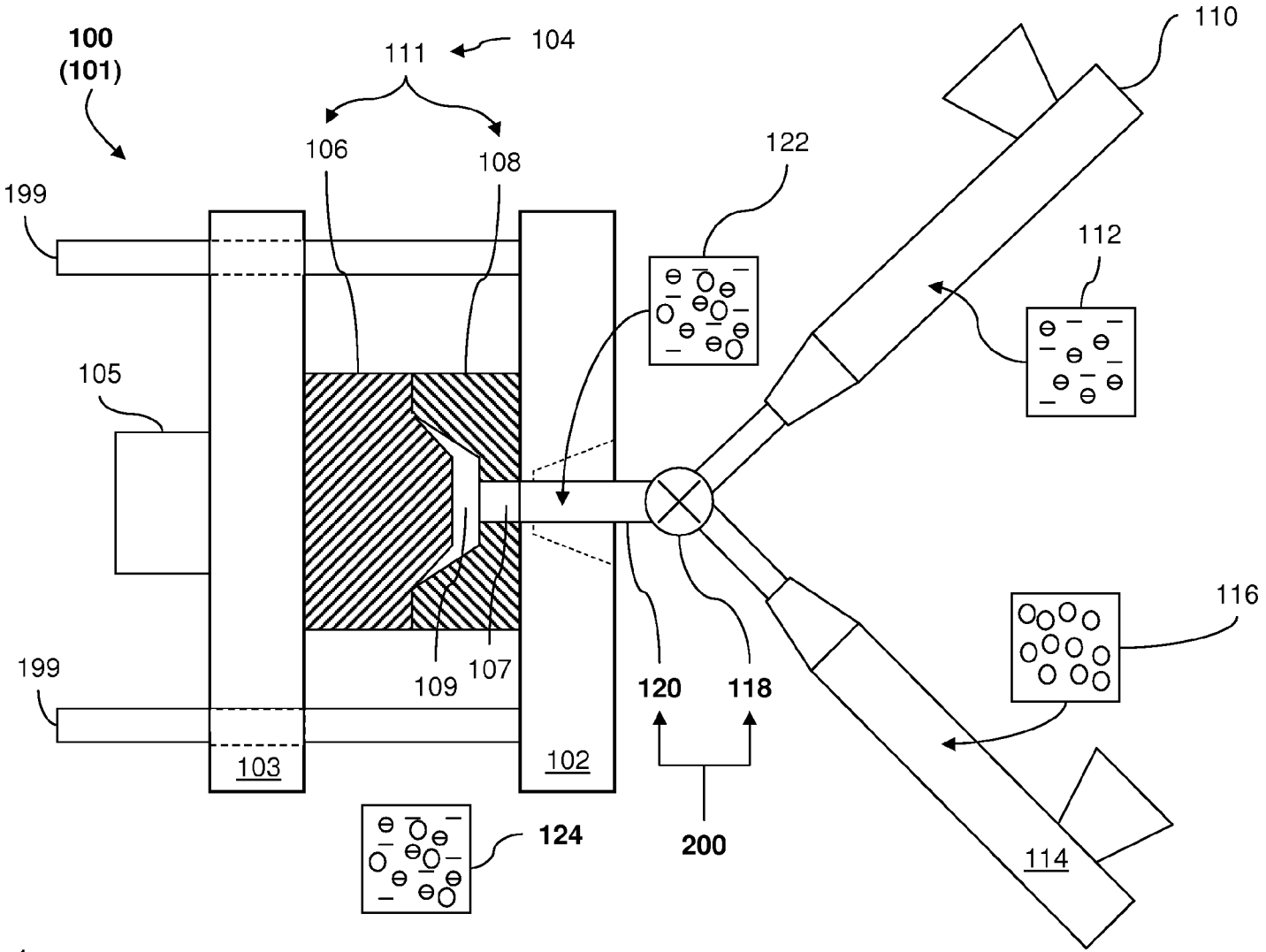
FIG. 1 depicts a schematic representation of a metal injection-molding system according to a first non-limiting embodiment.

The drawings are not necessarily to scale and are sometimes illustrated by phantom lines, diagrammatic representations and fragmentary views. In certain instances, details that are not necessary for an understanding of the embodiments or that render other details difficult to perceive may have been omitted.

REFERENCE NUMERALS USED IN THE DRAWINGS

The following is a listing of the elements designated to each reference numeral used in the drawings:

a material input, 2
metal injection-molding process, 10
receiving operation, 12
heating operation, 14
combining operation, 16
injecting operation, 18
metal injection-molding system, 100
metal-injection molding system, 101
stationary platen, 102
movable platen, 103
mold, 104
clamping mechanism, 105
movable mold portion, 106
mold gate, 107
stationary mold portion, 108
mold cavity, 109
first injection mechanism, 110
mold body, 111
molten-metallic alloy, 112
solidified-metallic alloy, 113
second injection mechanism, 114
spacing agent, 116
combining valves, 118, 218, 318, 418
conduit, 120
combined alloy, 122
molded-foamed-metallic article, 124
nozzles, 190, 192
tie bars, 199
combining chamber, 200
plunger, 206
channel, 208
shooting pot valve, 202
shooting pot, 204
screws, 292, 294
hot runner, 402
manifold, 404
conduits, 406, 426
switching valves, 408, 428
conduits, 410, 430
shooting pots, 412, 432
pressure chambers, 414, 434
accumulation chambers, 416, 436
pistons, 417, 437
conduit, 420
metal injection-molding system, 500
conduit, 502
nozzles, 504, 506
mold gate, 507
mold cavity, 509
receiving means, 512
heating means, 514
combining means, 516
injection means, 518

DETAILED DESCRIPTION OF THE NON-LIMITING EMBODIMENTS

FIG. 1 depicts the schematic representation of the metal injection-molding system 100 (hereafter referred to as the "system 100") according to the first non-limiting embodiment. Preferably, the system 100 includes a metal-injection molding system 101. The system 100 may include some components that are known to persons skilled in the art, and these known components will not be described here; these known components are described, at least in part, in the following text books (by way of example): (i) "*Injection Molding Handbook*" by Osswald/Turng/Gramann (ISBN: 3-446-21669-2; publisher: Hanser), (ii) "*Injection Molding Handbook*" by Rosato and Rosato (ISBN: 0-412-99381-3; publisher: Chapman & Hill), and/or (iii) "*Injection Molding Systems*" 3rd Edition by Johannaber (ISBN 3-446-17733-7).

According to the first non-limiting embodiment, the system 100 includes a first injection mechanism 110 (hereafter referred to as the "mechanism 110") that is configured to process a molten-metallic alloy 112 (hereafter referred to as the "alloy 112"). The system 100 also includes a second injection mechanism 114 (hereafter referred to as the "mechanism 114") that is configured to process a spacing agent 116. The combination of the alloy 112 and the spacing agent 116 will be, from time to time, referred to as the "inputs" for the sake of simplifying the detailed description. Once the spacing agent 116 is combined with the alloy 112, the alloy 112 and the spacing agent 116 may solidify (in a mold 104) into a molded-foamed-metallic article 124 (hereafter referred to as the "article 124"). According to non-limiting variants, the spacing agent 116 includes any one of (for example, but not limited to): (i) a gas, (ii) a non-reactive solid being non-reactive with the alloy 112, and/or (iii) a reactive solid being reactive with the alloy 112. Examples of the spacing agent 116 are described in technical articles, titled: (i) METALLIC FOAMS—ULTRA LIGHT MATERIALS FOR STRUCTURAL APPLICATIONS; Author: FRANTIEK SIMANCIK; Technical Journal Name: INZYNIERIA MATERIALOWA Nr. 5/2001, and (ii) PRODUCTION AND PROPERTIES OF FOAMED MAGNESIUM; Authors: Fr.-W. BACH, 0. BORMAUN, P. WILK, R. KUCHARSKI; Journal Title: CELLULAR METALS AND POLYMERS 2004; edited by R. F. Singer; C. Körner, V. Altstadt, Fragezeiche). The spacing agent 116 may also be called a foaming agent, in that by combining the spacing agent 116 with the alloy 112, an article may be molded to form a molded-foamed-metallic article, which includes "spaces" primarily located in the solidified alloy of the molded article; the spaces in the molded article may also be called "voids" or the spaces may contain a material that is lighter (in weight and/or density) than (the weight and/or density of) the solidified alloy. According to a non-limiting variant, the spacing agent 116 includes hollow-sphere structures that are made of a material being different than the alloy 112. The hollow-sphere structures do not (for the most part) melt in the alloy 112. The hollow-sphere structures may be pre-produced by different techniques. It is possible to manufacture hollow spheres with: (i) a diameter in a range from about 1 to about 10 millimeters (mm), and/or (ii) a mantle thicknesses from about 20 to about 50 micrometers (μm). The hollow-sphere structures may be manufactured in principle by sintering, soldering and/or sticking. Hollow-sphere structures on iron basis are producible in a far density range, from about 0.2 to 1.5 grams per cubic centimeter ($g/cm^3$). The operational areas lie for example in lightweight construction, in heat and acoustic noise insulation, as crash absorber or carrier material for functional applications, etc. Details regarding the hollow spheres may be obtained from Dr.-Ing. Guenter Stephani at the Fraunhofer-Institut für Fertigungstechnik und Angewandte Materialforschung, Institutsteil Dresden IFAM-DD, Winterbergstr. 28, 01277 Dresden, Germany.

There are several options (but not limited thereto) available for manufacturing the article 124: (i) injecting a mixture of a flowable alloy (either a molten, liquid metal or a semisolid metal) and a gas (which is an example of a spacing agent 116) into a mold, and the mixture solidifies in the mold to form the foamed alloy, (ii) injecting a mixture of a flowable alloy (either a molten, liquid metal or a semisolid metal) and a space holder (which is an example of a spacing agent 116), in which examples of the space holder are: organic granules and/or inorganic granules which may remain in the solidified metallic foamed alloy or may be removed from the solidified metallic foamed alloy by a thermal treatment and/or a chemical treatment, (iii) injecting a mixture of a flowable alloy (either a molten, liquid metal or a semisolid metal) and hollow spheres (which is an example of a spacing agent 116), and/or (iv) injecting a mixture of a flowable alloy (either a molten, liquid metal or a semisolid metal) and a blowing agent (which is an example of a spacing agent 116), in which the blowing agent decomposes under the influence of heat and releases gas which propels the foaming process. Under option (iv), the blowing agent is mixed with a parent material, the blowing agent and the parent material are activated by heat so as to create foam responsive to the blowing agent experiencing a drop in pressure. In other words, the blowing agent and the parent material must be mixed, heated, injected, etc while under pressure to stop the blowing agent and the parent material from foaming until the blowing agent and the parent material are (preferably, completely) inside a mold cavity, where the blowing agent and the parent material experience a reduction in pressure due to the larger volume of the mold cavity (when compared to the melt channels, etc) and consequently the blowing agent and the parent material "foam" within the confines of the molded part and (preferably) not foam elsewhere in the melt conduit. In fact in some processes, a mold-clamp force is reduced to allow the mold to partially blow open thereby further reducing the pressure resisting foaming.

The mechanism 110 and the mechanism 114 each include: (i) respective reciprocating screws (not depicted in FIG. 1, but depicted in FIG. 6 and FIG. 7, by way of example) that are mounted in respective barrels (depicted but not numbered) of the mechanism 110 and the mechanism 114, and (ii) respective hoppers (depicted but not numbered) that are attached to feed throats (depicted but not numbered) of their respective barrels. The hopper associated with mechanism 110 is to receive solidified particles (sometimes called "chips" or "blocks") of the alloy 112. The hopper (that is, a receiving mechanism) associated with the mechanism 114 is to receive the spacing agent 116.

The system 100 also includes: (i) a stationary platen 102, and (ii) a movable platen 103. The stationary platen 102 is configured to support a stationary mold portion 108 of the mold 104. The movable platen 103 is configured to: (i) move relative to the stationary platen 102 (by use of a stroking actuator that is not depicted, but is known), and (ii) support a movable mold portion 106 of the mold 104. The mold 104 is usually supplied separately from the system 100. It is understood that the mold 104 is a component that wears down over time and is to be replaced as may be required. The mold 104 has a mold body 111 that includes: (i) the stationary mold portion 108, and (ii) the movable mold portion 106, which in combination define a mold cavity 109 once the movable platen 103 is made to move toward the stationary platen 102 sufficiently enough as to abut the stationary mold portion 108 against the movable mold portion 106. The mold body 111 is used to moldably manufacture the article 124. The stationary mold portion 108 defines a mold gate 107 that leads to the mold cavity 109. The system 100 also includes a clamping mechanism 105 that is coupled to: (i) the stationary platen 102 (via tie bars 199), and (ii) the movable platen 103. Specifically, the tie bars 199 are: (i) connected to the stationary platen 102, and (ii) extend to the movable platen 103. The tie bars 199 are lockably engageable and disengageable to the movable platen 103 by locking mechanisms (not depicted) that are known to those skilled in the art (and therefore will not be described in the detailed description). The movable platen 103 may be used to house or support the locking mechanisms at respective corners of the movable platen 103. The tie bars 199 assist in coupling the clamping mechanism 105 to the stationary platen 102 when the locking mechanisms lock the tie bars 199 to the movable platen 103. Once the platens 102, 103 are stroked so as to close the mold 104, the locking mechanisms are engaged, the clamping mechanism 105 may then be engaged so as to apply a clamp tonnage (also called a clamping force) to the platens 102, 103 and in this manner the clamp tonnage may be applied to the mold 104; since the process of applying clamp tonnage is known to those skilled in the art, the process is not further described in the detailed description. It will be appreciated that the tie bars 199 will not be depicted in the remaining FIGS. for the sake of simplifying the remaining FIGS and the description associated with the remaining FIGS.

The system 100 also includes a combining chamber 200 (hereafter referred to as the "chamber 200"). The combining chamber 200 is configured to receive the alloy 112 and the spacing agent 116. The alloy 112 and the spacing agent 116 are injectable under pressure into the combining chamber 200. The alloy 112 and the spacing agent 116 are combinable, at least in part, under pressure in the combining chamber 200. The combining chamber 200 is also configured to convey, under pressure, the alloy 112 and the spacing agent 116 toward a mold 104. The alloy 112 combined with the spacing agent 116 are solidifiably formable into a molded-foamed-metallic article 124 in the mold 104. It will be appreciated that the system 100 and the chamber 200 may be supplied or sold separately or sold integrated.

According to a non-limiting variant, the chamber 200 is configured to: (i) receive the alloy 112 that is injectable under pressure from the mechanism 110, and (ii) receive the spacing agent 116 that is injectable under pressure from the mechanism 114 so that, in effect, the alloy 112 and the spacing agent 116 combine, at least in part (under pressure), to form a combined alloy 122 in the chamber 200. The combined alloy 122 is a combination of the alloy 112 and the spacing agent 116. It is understood that the combined alloy 122 is not necessarily a combination of two alloys per se (that is, the combined alloy 122 may be a combination of several alloys or just one alloy; the combined alloy includes at least one alloy combined with at least one spacing agent). The combined alloy 122 may be referred to as an output alloy, but is hereafter referred to as the "alloy 122". The chamber 200 is also configured to: (iii) communicate, under pressure, the alloy 122 to the mold gate 107 that leads to the mold cavity 109 that is defined by the mold 104 once the platens 102, 103 are stroked together so as to close the mold 104. The alloy 112 and the spacing agent 116 may be collectively referred to a "plurality of inputs" or the "inputs", in that at least two or more inputs may be combined in the chamber 200. Preferably (but not essential) the chamber 200 includes a mixing element (not depicted) that is used to improve the mixing (or combining) of the alloy 112 with the spacing agent 116 in the chamber 200.

The alloy 112 and spacing agent 116 are introduced into the mechanism 110 and the mechanism 114, respectively. Once the alloy 112 is introduced (in the form of solid chips, etc) to the mechanism 110, the mechanism 110 converts the alloy 112 primarily into a thixotropic state (sometimes referred to as the "semi-solid state") so that the alloy 112 contains a mixture of liquid and solid particles of globular shape, etc. Alternatively, the mechanism 110 may convert the alloy 112 primarily into the liquid state. It is understood that the mechanism 110 may condition or process the alloy 112 so that the alloy 112 may exist primarily in: (i) the liquid state, or (ii) the semi-solid state.

A technical effect of this arrangement is that the alloy 122 may be manufactured having desired (or predetermined) characteristics (or attributes) that are associated with the alloy 112 and with the spacing agent 116. After combining or mixing the alloy 112 with the spacing agent 116, the alloy 122 is created. The alloy 122 solidifies in the mold cavity 109 and is formed into the article 124. The article 124 is removable from the mold 104 after: (i) the clamping mechanism 105 has ceased applying the clamp tonnage between the movable platen 103 and the stationary platen 102 (this includes application of a mold-break force to the mold 104 by usage of a mold-break actuator, which is known to those skilled in the art and not depicted), and (ii) the movable platen 103 has been moved away from the stationary platen 102 so as to separate the stationary mold portion 108 from the movable mold portion 106. The article 124 may be: (i) ejected from the mold 104 by ejection mechanisms (not depicted, but known to those skilled in the art), or (ii) may be removed by a robot (not depicted, but known to those skilled in the art).

According to non-limiting variants, the chamber 200 includes a combining valve 118. The combining valve 118 is configured to: (i) couple to the mechanism 110, and (ii) couple to the mechanism 114. The chamber 200 also includes a conduit 120 that is configured to: (i) couple to the combining valve 118, and (ii) couple to the mold gate 107 of the mold 104. The combining valve 118 is operable between: (i) a non-flow state, and (ii) a flow state. In the non-flow state, the combining valve 118 is configured to: (i) not receive the alloy 112 from the mechanism 110, and (ii) not receive the spacing agent 116 from the mechanism 114. In the flow state, the combining valve 118 is configured to: (i) receive the alloy 112 from the mechanism 110, and (ii) receive the spacing agent 116 from the mechanism 114. The alloy 112 and the spacing agent 116 combine, at least in part, to form the alloy 122 in the combining valve 118. The conduit 120 is configured to: (i) receive the alloy 122 from the combining valve 118, and (ii) communicate the alloy 122 to the mold gate 107 of the mold 104.

Figure 2:
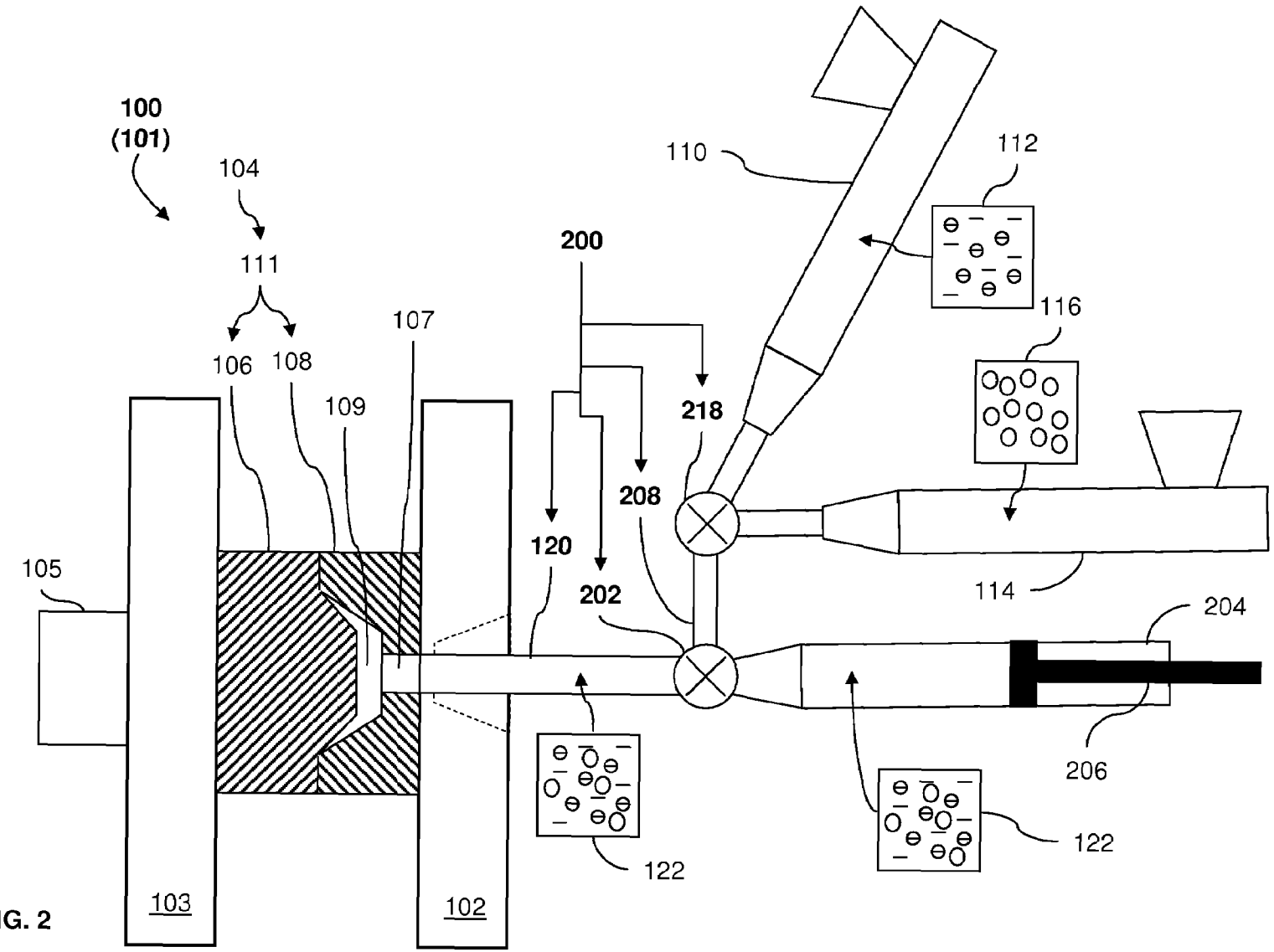
FIG. 2 depicts a schematic representation of a metal injection-molding system according to a second non-limiting embodiment.

FIG. 2 depicts the schematic representation of the system 100 according to the second non-limiting embodiment. According to the second non-limiting embodiment, the chamber 200 includes a combining valve 218 that is configured to: (i) couple to the mechanism 110, and (ii) couple to the mechanism 114. The chamber 200 also includes a channel 208 that is configured to couple to the combining valve 218. The chamber 200 also includes a shooting pot valve 202 that is configured to couple to the channel 208. The chamber 200 also includes a shooting pot 204 that is configured to couple to the shooting pot valve 202. The shooting pot 204 includes a plunger 206 that is movable in the shooting pot 204. The chamber 200 also includes a conduit 120 that is configured to couple to: (i) the shooting pot valve 202, and (ii) the mold gate 107 of the mold 104. The combining valve 218 is operable between a non-flow state, and a flow state. In the non-flow state, the combining valve 218 is configured to: (i) not receive the alloy 112 from the mechanism 110, and (ii) not receive the spacing agent 116 from the mechanism 114. In the flow state, the combining valve 218 is configured to: (i) receive the alloy 112 from the mechanism 110, and (ii) receive the spacing agent 116 from the mechanism 114. The alloy 112 and the spacing agent 116 combine, at least in part, to form the alloy 122 in the combining valve 218. The channel 208 is configured to receive the alloy 122 from the combining valve 218. The shooting pot valve 202 is operable between a first valve state, and a second valve state. In the first valve state, the shooting pot valve 202 is configured to not receive the alloy 122 from the channel 208. In the second valve state, the shooting pot valve 202 is configured to receive the alloy 122 from the channel 208. The shooting pot 204 is configured to receive the alloy 122 from the shooting pot valve 202 once the shooting pot valve 202 is placed in the second valve state. The shooting pot valve 202 is configured to disconnect the channel 208 from the shooting pot 204 once the shooting pot valve 202 is placed in the first valve state. The conduit 120 is configured to: (i) receive the alloy 122 from shooting pot valve 202 once the shooting pot valve 202 is placed in the first valve state, and (ii) communicate the alloy 122 to the mold gate 107 of the mold 104.

Figure 3:
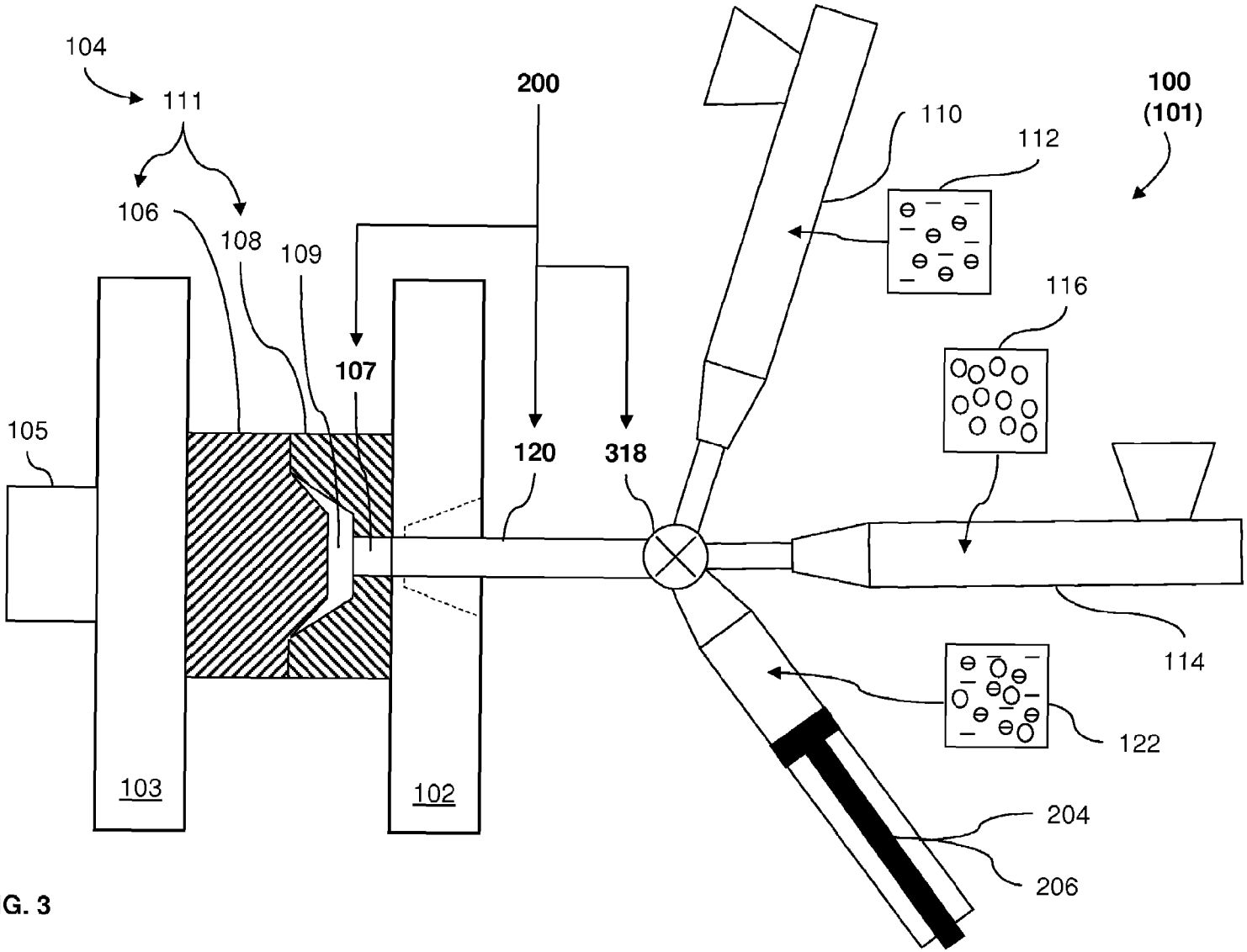
FIG. 3 depicts a schematic representation of a metal injection-molding system according to a third non-limiting embodiment.

FIG. 3 depicts the schematic representation of the system 100 according to the third non-limiting embodiment. According to the third non-limiting embodiment, the chamber 200 includes a combining valve 318 that is configured to: (i) couple to the mechanism 110, (ii) couple to the mechanism 114, and (iii) couple to a shooting pot 204. The chamber 200 also includes a conduit 120 that is coupled to: (i) the combining valve 318, and (ii) the mold gate 107 of the mold 104. The combining valve 318 is operable between a first state, and a second state. In the first state, the combining valve 318 is configured to: (i) receive the alloy 112 from the mechanism 110, (ii) receive the spacing agent 116 from the mechanism 114 (the alloy 112 and the spacing agent 116 combine, at least in part, to form the alloy 122 in the combining valve 318), and (iii) transmit the alloy 122 to a shooting pot 204. In the second state, the combining valve 318 is configured to: (i) not receive the alloy 112 from the mechanism 110, (ii) not receive the spacing agent 116 from the mechanism 114, and (iii) permit the shooting pot 204 to shoot the alloy 122 back into the combining valve 318. The conduit 120 is configured to: (i) communicate the alloy 122, under pressure, from the combining valve 318 to the mold gate 107 once the combining valve 318 is placed in the second state.

Figure 4:
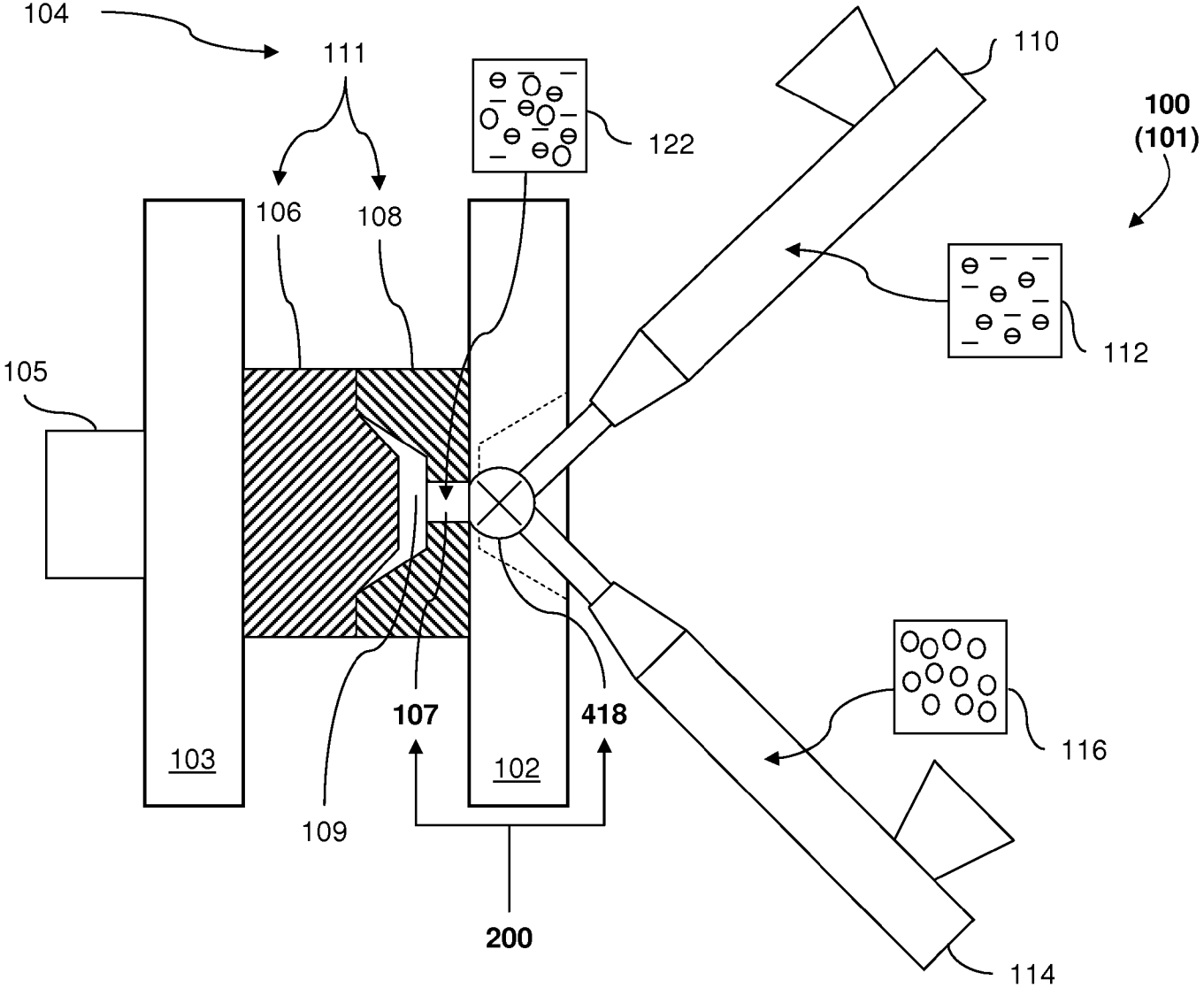
FIG. 4 depicts a schematic representation of a metal injection-molding system according to a fourth non-limiting embodiment.

FIG. 4 depicts the schematic representation of the system 100 according to the fourth non-limiting embodiment. According to the fourth non-limiting embodiment, the chamber 200 includes a combining valve 418 that is configured to: (i) couple to the mechanism 110, (ii) couple to the mechanism 114, and (iii) couple to the mold gate 107 of the mold 104. The combining valve 418 is operable between a first state, and a second state. In the first state, the combining valve 418 is configured to: (i) receive the alloy 112 from the mechanism 110, (ii) receive the spacing agent 116 from the mechanism 114 (the alloy 112 and the spacing agent 116 combine, at least in part, in the combining valve 418 so as to form the alloy 122), and (iii) communicate the alloy 122 to the mold gate 107 of the mold 104. In the second state, the combining valve 418 is configured to: (i) not receive the alloy 112 from the mechanism 110, and (ii) not receive the spacing agent 116 from the mechanism 114.

Figure 5:
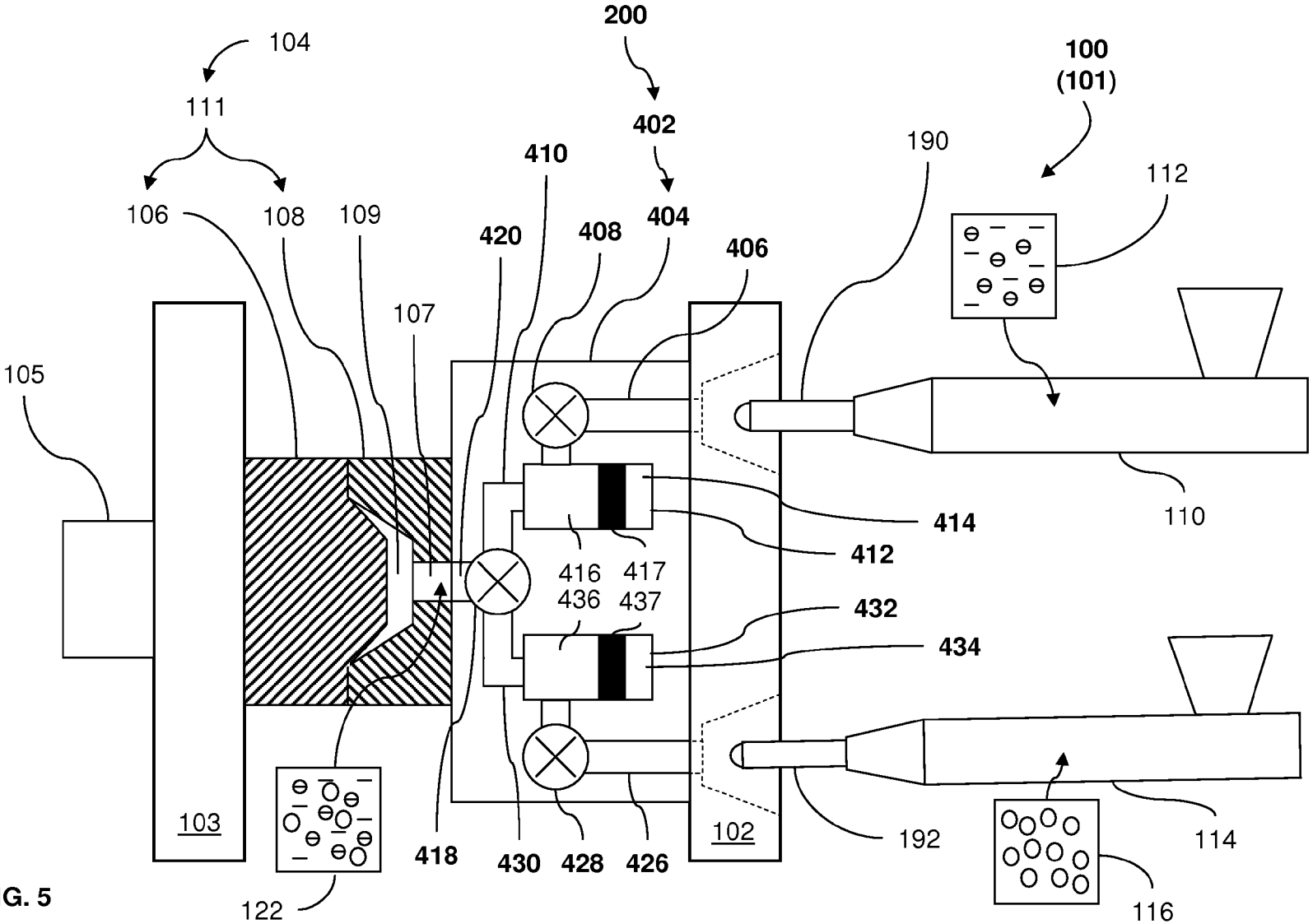
FIG. 5 depicts a schematic representation of a metal injection-molding system according to a fifth non-limiting embodiment.

FIG. 5 depicts the schematic representation of the system 100 according to the fifth non-limiting embodiment. According to the fifth non-limiting embodiment, the chamber 200 includes a hot runner 402. The hot runner 402 includes a manifold 404. The manifold 404 is configured to support: (i) switching valve 408 and switching valve 428, (ii) a shooting pot 412 and a shooting pot 432, and (iii) a combining valve 418. The shooting pot 412 and the shooting pot 432 may collectively be known as the "shooting pots 412, 432". The switching valve 408 and the switching valve 428 may collectively be known as the "switching valves 408, 428". The switching valve 408 and the switching valve 428 are coupled (via conduits 406, 426 respectively) to the mechanism 110 and the mechanism 114 (respectively) so as to receive the alloy 112 and spacing agent 116 from the mechanism 110 and the mechanism 114 respectively (that is, once the nozzle 190 and the nozzle 192 of the mechanism 110 and the mechanism 114, respectively, are made to contact the conduits 406, 426 respectively). Preferably, the nozzles 190, 192 are maintained in contact (during operation of the system 100) with their respective conduits 406, 426. The nozzles 190, 192 are depicted offset from the conduits 406, 426 respectively for illustration purposes. The shooting pot 412 and the shooting pot 432 are coupled to the switching valve 408 and the switching valve 428 respectively (preferably via conduits). The combining valve 418 is coupled to the shooting pot 412 and the shooting pot 432 (via conduits 410, 430) and is also coupled to the mold gate 107 (via a conduit 420). A hot-runner nozzle (not depicted in this non-limiting embodiment) may be inserted in the conduit 420 if so required to control the release of molding material (that is the alloy 122) into the mold cavity 109 of the mold 104. According to a non-limiting variant, the switching valve 408 and switching valve 428 are "on/off" valves that are switchable (or operable) between a non-flow state and a flow state. According to another non-limiting variant, the switching valve 408 and the switching valve 428 are "on/off/variable-flow" valves that are switchable (or operable) between: (i) a non-flow state, (ii) a full-flow state and (iii) a partial-flow state. According to yet another non-limiting variant, the combining valve 418 is an "on/off" valve that is switchable (or operable) between: (i) a non-flow state, and (ii) a flow state. According to yet another non-limiting variant, the combining valve 418 is an "on/off/variable-flow" valve that is switchable (or operable) between: (i) a non-flow state, (ii) a full-flow state, and (iii) a partial-flow state.

The shooting pot 412 and the shooting pot 432, include: (i) a pressure chamber 414 and a pressure chamber 434 respectively, (ii) an accumulation chamber 416 and an accumulation chamber 436 respectively, and (iii) a piston 417 and a piston 437 respectively that are each slidably movable within their respective accumulation chambers 416, 436. The pressure chamber 414 and the pressure chamber 434 may collectively be known as the "pressure chambers 414, 434". The pressure chambers 414, 434 are fillable with a pressurizable fluid, such as compressed air, or can be actuated by a remote drive not shown. If hydraulic oil is used, care must be used because the temperatures needed for processing metal alloys may cause hydraulic oil to ignite. It will be appreciated that the shooting pot 412 and the shooting pot 432 may be actuated by electrical actuators (not depicted), etc. In operation, initially the combining valve 418, the switching valve 408 and the switching valve 428 are placed in the non-flow state. The pressure chamber 414 and the pressure chamber 434 are de-pressurized so as to permit respective pistons 417, 437 to retract (that is, to be movable). The mechanism 110 and the mechanism 114 are configured to process and prepare the alloy 112 and spacing agent 116, respectively. After the mechanism 110 and the mechanism 114 are each ready to inject or shoot the alloy 112 and the spacing agent 116 respectively, the combining valve 418 remains in the non-flow state, and the switching valve 408 and the switching valve 428 are placed in the flow state, and then the mechanisms 110, 114 inject the alloy 112 and the spacing agent 116, respectively, into the conduits 406, 426 respectively so that (in effect) the alloy 112 and spacing agent 116 may be injected, under pressure, into the accumulation chambers 416, 436 of the shooting pots 412, 432 respectively; as a result, the pistons 417, 437 are moved into the pressure chambers 414, 434 respectively so as to displace the pressurizable fluid out from the pressure chambers 414, 434 respectively. Once the mechanism 110 and the mechanism 114 have completed their injection cycle, the switching valve 408 and the switching valve 428 are placed in the non-flow state, the combining valve 418 is placed in the flow state (either full-flow or partial flow, etc, as may be required to achieve a desired combination of the alloy 112 and spacing agent 116), and the pressure chambers 414, 434 are pressurized (that is, filled with the pressurizable fluid); as a result, the pistons 417, 437 are moved into their respective accumulation chambers 416, 436 respectively so as to inject or push the alloy 112 and the spacing agent 116 respectively into the combining valve 418. Then the alloy 112 and spacing agent 116 become combined, at least in part in the combining valve 418, to form the alloy 122. The alloy 122 then is pushed, under pressure, through the conduit 420 into the mold gate 107. The combining valve 418 may be used or arranged so that a desired ratio of the alloy 112 and spacing agent 116 may be realized. The switching valve 408 and the switching valve 428 may be used so as to permit a desired amount of flow of the alloy 112 and of the spacing agent 116 into the accumulation chambers 416, 436 respectively (as may be required). It will be appreciated that a single drop (that is, the conduit 420) is depicted, and that the non-limiting embodiment may be modified to operate with a plurality of drops that: (i) all lead into a single mold cavity (as depicted), or (ii) lead into separate mold cavities (not depicted).

Figure 6:
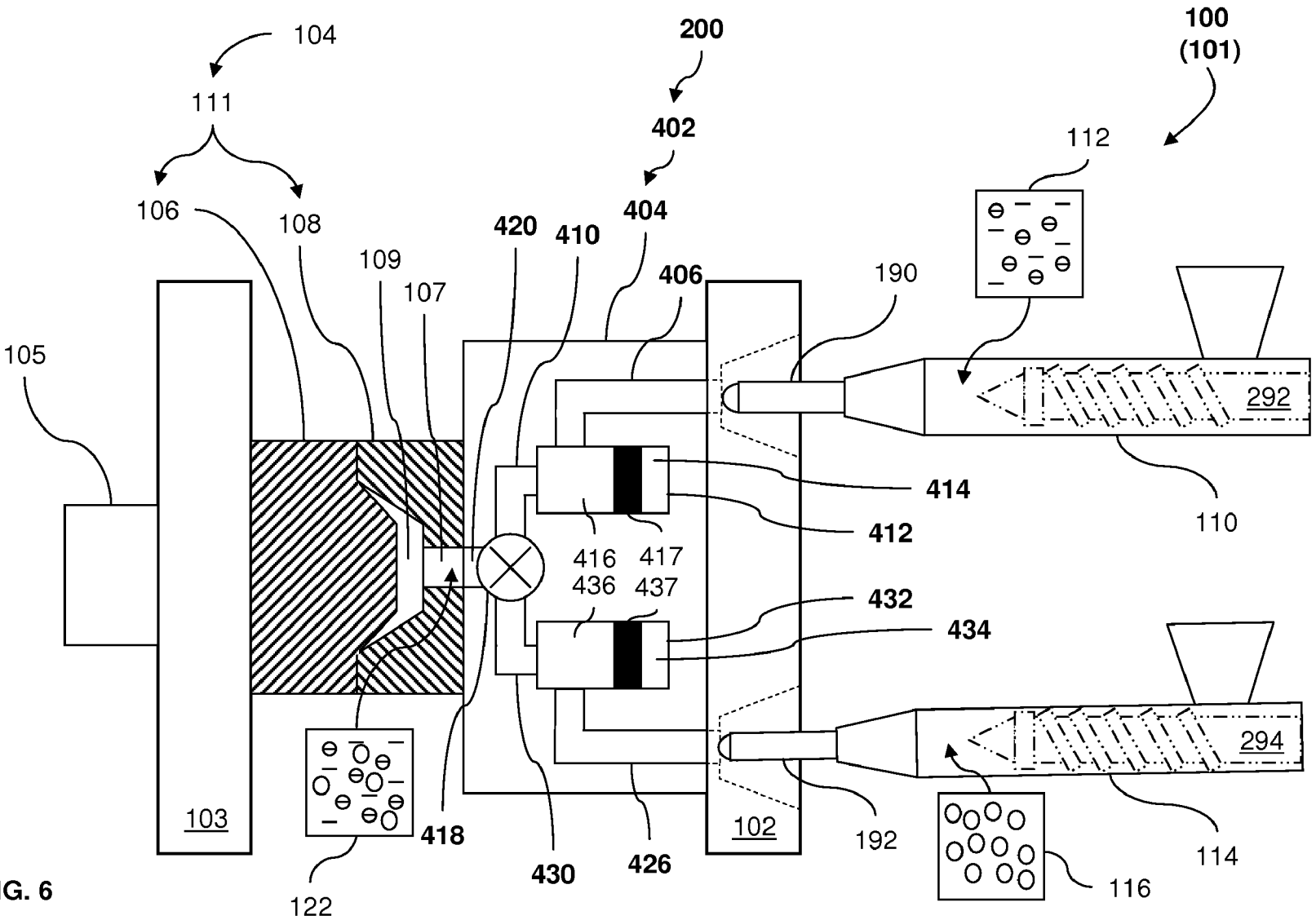
FIG. 6 depicts a schematic representation of a metal injection-molding system according to a sixth non-limiting embodiment.

FIG. 6 depicts the schematic representation of the system 100 according to the sixth non-limiting embodiment. According to the sixth non-limiting embodiment, the manifold 404 is configured to support: (i) the shooting pot 412 and the shooting pot 432, and (iii) the combining valve 418. The shooting pots 412, 432 are coupled to the mechanisms 110, 114 (respectively) so as to receive the inputs from the mechanisms 110, 114 respectively. The combining valve 418 is coupled to: (i) the shooting pots 412, 432, and (ii) the mold gate 107. The switching valves 408, 428 of the fifth non-limiting embodiment are not used in the sixth non-limiting embodiment. In operation, the combining valve 418 is operated in the non-flow state, and the mechanism 110 and the mechanism 114 accumulate their respective shots of alloys and then inject the alloy 112 and spacing agent 116 respectively into the accumulation chambers 416, 436 (so that in effect, the shots of the alloy 112 and the spacing agent 116 are transferred into the accumulation chambers 416, 436). Once the shots are received in the accumulation chambers 416, 436, (i) screws 292, 294 of the mechanisms 110, 114 respectively (the screws 292, 294 are equipped with non-return valves) maintain their positions so as to prevent flow of the alloy 112 and the spacing agent 116 back into the mechanisms 110, 114 respectively, and (ii) the combining valve 418 is placed in the flow state. The pressure chamber 414 and the pressure chamber 434 are pressurized so as to move their respective pistons 417, 437 into the accumulation chambers 416, 436 respectively so as to inject or push the alloy 112 and the spacing agent 116 from the accumulation chambers 416, 436 respectively into the combining valve 418. A hot-runner nozzle (not depicted) may be inserted in the conduit 420 if so required to control the release of molding material into the mold cavity 109 of the mold 104. It will be appreciated that a single drop (that is, conduit 420) is depicted, and that the non-limiting embodiment may be modified to operate with a plurality of drops that lead into the mold cavity 109 (or that lead into separate mold cavities (not depicted).

Figure 7:
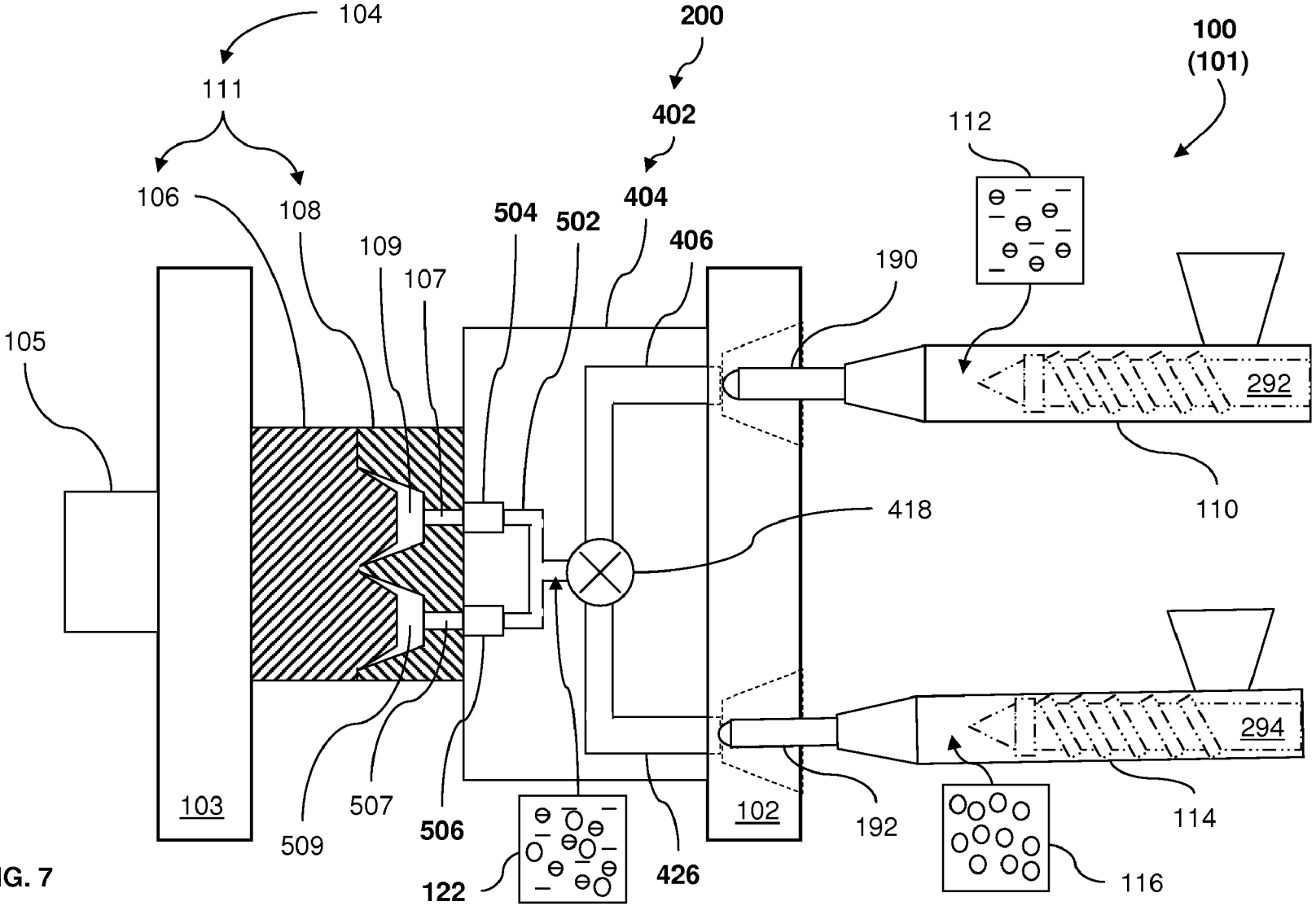
FIG. 7 depicts a schematic representation of a metal injection-molding system according to a seventh non-limiting embodiment.

FIG. 7 depicts the schematic representation of the system 100 according to the seventh non-limiting embodiment. According to the seventh non-limiting embodiment, the mold 104 defines the mold cavity 109 and the mold cavity 509. The mold cavities 109, 509 may be known collectively as mold cavities 109, 509. Associated with each of the mold cavities 109, 509 is the mold gate 107 and a mold gate 507, respectively, that each lead to the mold cavity 109 and the mold cavity 509 respectively. The manifold 404 supports the nozzles 504, 506 (sometimes referred to as "hot-runner nozzles") that are coupled (via conduit 502) to the combining valve 418, and also coupled to respective mold gates 107, 507. In operation, the alloy 112 and spacing agent 116 combine to form the alloy 122 (at least in part) in the combining valve 418, the conduit 502, and the nozzles 504, 506.

Figure 8:
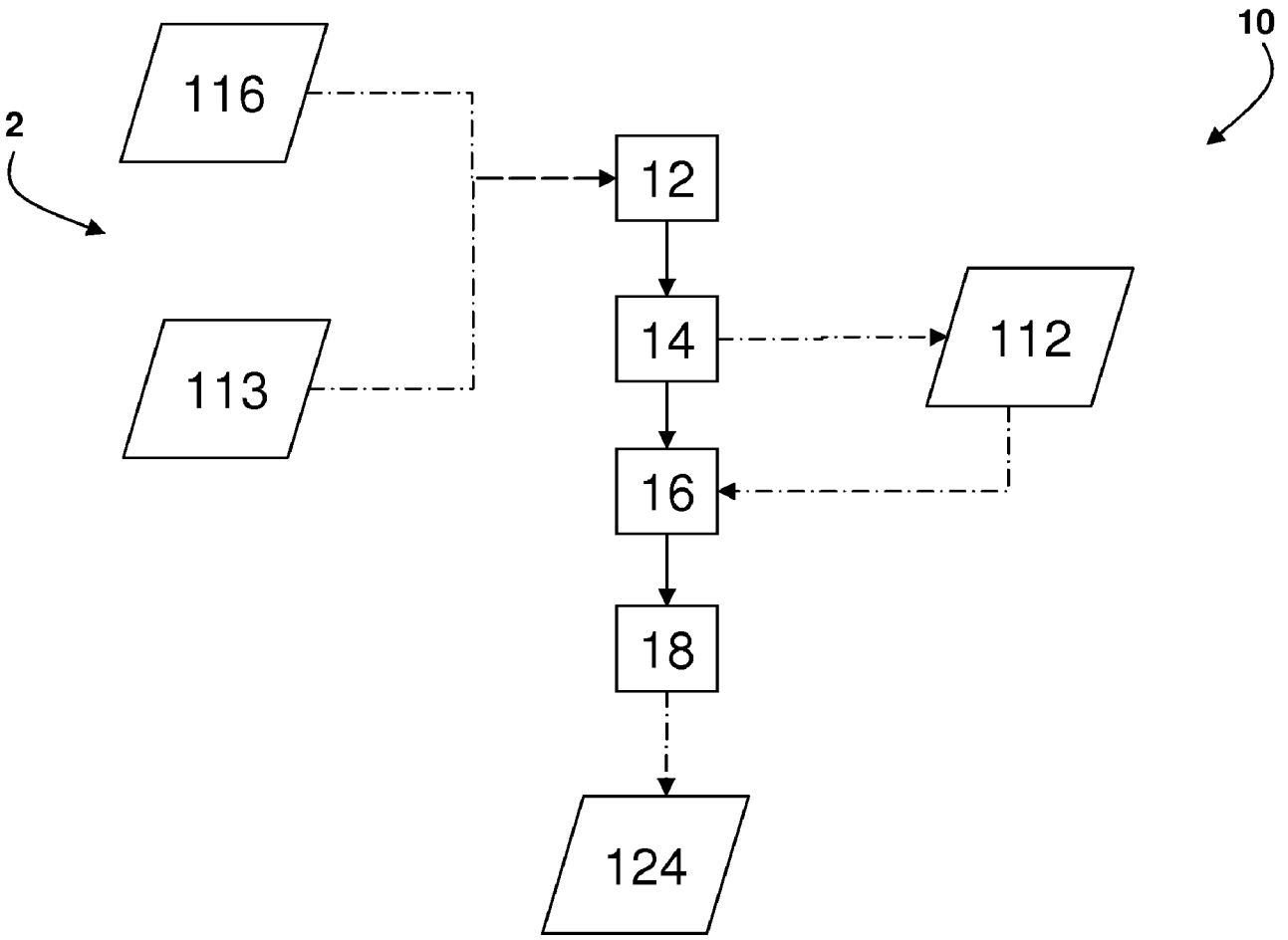
FIG. 8 depicts a schematic representation of a metal injection-molding process 10 according to the eighth non-limiting embodiment.

FIG. 8 depicts the schematic representation of the metal injection-molding process 10 (hereafter referred to as the "process 10") according to the eighth non-limiting embodiment. Generally, the process 10 includes injecting, under pressure, the alloy 112 and the spacing agent 116 into the mold 104. According to a non-limiting variant, the process 10 includes: (i) a receiving operation 12, (ii) a heating operation 14, (iii) a combining operation 16 and (iv) an injecting operation 18. The receiving operation 12 includes receiving a solidified-metallic alloy 113 and the spacing agent 116. The heating operation 14 includes heating the solidified-metallic alloy 113 associated with the receiving operation 12 above a solidus temperature of the solidified-metallic alloy 113 so that the solidified-metallic alloy 113 may become the alloy 112. The combining operation 16 includes combining the alloy 112 associated with the heating operation 14 with the spacing agent 116 associated with the receiving operation 12. The injecting operation 18 includes injecting, under pressure, the alloy 112 and the spacing agent 116 into the mold 104. At a minimum, the alloy 112 is heated above a solidus temperature of the alloy 112 but below a liquidus temperature of the alloy 112 (so that the alloy 112 may exist in a semi-solid state). Optionally, the alloy 112 is heated above a liquidus temperature of the alloy 112 (so that the alloy 112 exists primarily in a liquid state). The alloy 112 includes an AZ91D alloy, and the liquidus temperature of the AZ91D alloy is nominally 595 degrees Centigrade (° C.). The alloy 112 includes a zinc alloy. According to non-limiting variants: (i) the alloy 112 includes a magnesium alloy, and/or (ii) an aluminum alloy. A material input 2 is used by the process 10, and the material input includes at least the alloy 112 and/or the spacing agent 116. The article 124 is made by the process 10. The system 100 of FIG. 1 is operable according to the process 10 of FIG. 8.

Figure 9:
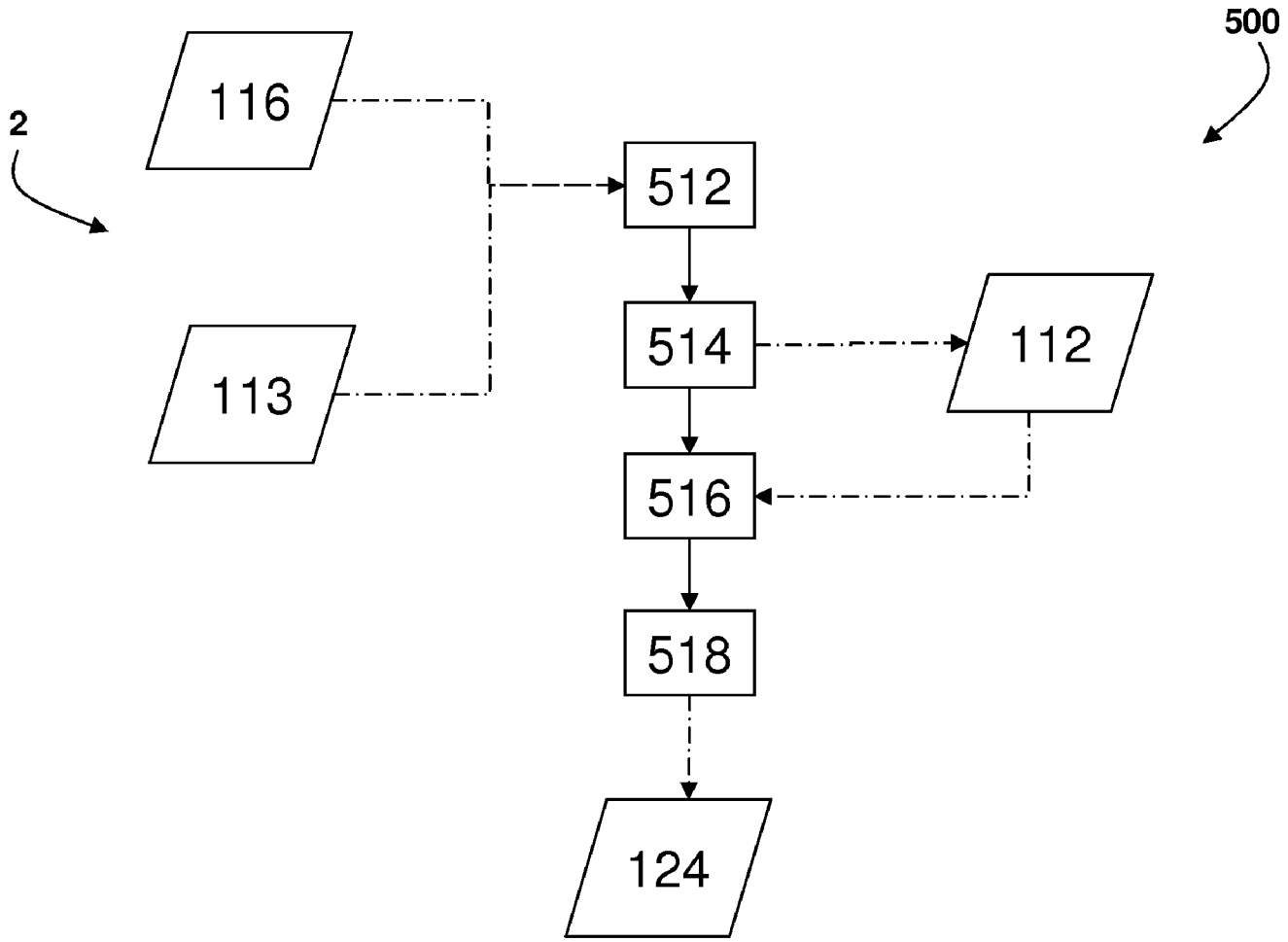
FIG. 9 depicts a schematic representation of a metal injection-molding system 500 operable according to the metal injection-molding process 10 of FIG. 8.

FIG. 9 depicts a schematic representation of the metal injection-molding system 500 operable according to the process 10 of FIG. 8. The metal injection-molding system 500 includes: (i) receiving means 512, (ii) heating means 514, (iii) combining means 516 and (iv) injection means 518. The receiving means 512 is configured to implement a receiving operation 12 including receiving the solidified-metallic alloy 113 and the spacing agent 116. The heating means 514 is configured to implement a heating operation 14 including heating the solidified-metallic alloy 113 associated with the receiving operation 12 above the solidus temperature of the solidified-metallic alloy 113 so that the solidified-metallic alloy 113 may become (or may be transformed into) the alloy 112. The combining means 516 is configured to implement a combining operation 16, including combining the alloy 112 associated with the heating operation 14 with the spacing agent 116 associated with the receiving operation 12. The injection means 518 is configured to implement an injecting operation 18, including injecting, under pressure, alloy 112 and the spacing agent 116 into the mold 104.

The description of the non-limiting embodiments provides examples of the present invention, and these examples do not limit the scope of the present invention. It is understood that the scope of the present invention is limited by the claims. The non-limiting embodiments described above may be adapted for specific conditions and/or functions, and may be further extended to a variety of other applications that are within the scope of the present invention. Having thus described the non-limiting embodiments, it will be apparent that modifications and enhancements are possible without departing from the concepts as described. It is to be understood that the non-limiting embodiments illustrate the aspects of the invention. Reference herein to details of the illustrated embodiments is not intended to limit the scope of the claims. The claims themselves recite those features regarded as essential to the present invention. Preferable embodiments of the present invention are subject of the dependent claims. Therefore, what is to be protected by way of letters patent are limited only by the scope of the following claims:

What is claimed is:

1. A method for operating a metal injection-molding system for use with a mold, the method comprising:

using a first injection mechanism to process a molten-metallic alloy;

using a second injection mechanism to process a foaming agent;

using a stationary platen to support a stationary mold portion of the mold;

using a movable platen to support a movable mold portion of the mold, the movable platen being movable relative to the stationary platen, the stationary mold portion and the movable mold portion forming a mold cavity once the movable platen is made to move toward the stationary platen enough as to abut the stationary mold portion against the movable mold portion, the stationary mold portion defining a mold gate leading to the mold cavity;

using a clamping mechanism to apply a clamp tonnage between the stationary platen and the movable platen;

connecting a combining chamber with the first injection mechanism and with the second injection mechanism;

using the combining chamber to receive the molten-metallic alloy and the foaming agent being injectable under pressure into the combining chamber, the molten-metallic alloy and the foaming agent combining, at least in part, under pressure in the combining chamber; and using the combining chamber to convey, under pressure, the molten-metallic alloy and the foaming agent to the mold, the molten-metallic alloy combined with the foaming agent being solidifiably formable into a molded-foamed-metallic article in the mold, further comprising:

using a combining valve of the combining chamber to receive the molten-metallic alloy and the foaming agent from respective injection mechanisms, the molten-metallic alloy and the foaming agent combining, at least in part, in the combining valve;

using a channel to receive the molten-metallic alloy and the foaming agent from the combining valve;

using a shooting pot valve having a first valve state and a second valve state, in the first valve state, the shooting pot valve does not receive the molten-metallic alloy and the foaming agent from the channel, and in the second valve state, the shooting pot valve receives the molten-metallic alloy and the foaming agent from the channel;

using a shooting pot to receive the molten-metallic alloy and the foaming agent from the shooting pot valve once the shooting pot valve is placed in the second valve state;

using the shooting pot valve to disconnect the channel from the shooting pot once the shooting pot valve is placed in the first valve state; and using a conduit to: (i) receive the molten-metallic alloy and the foaming agent from the shooting pot valve once the shooting pot valve is placed in the first valve state, and (ii) communicate the molten-metallic alloy and the foaming agent to the mold gate leading to the mold cavity defined by the mold.

2. The method of claim 1, further comprising:

using a mixing element to mix the molten-metallic alloy and the foaming agent in the combining chamber.

3. The method of claim 1, further comprising:

using a combining valve of the combining chamber to receive the molten-metallic alloy and the foaming agent from respective injection mechanisms, the molten-metallic alloy and the foaming agent combining, at least in part, in the combining valve; and using a conduit to: (i) receive the molten-metallic alloy and the foaming agent from the combining valve, and (ii) communicate the molten-metallic alloy and the foaming agent to the mold gate leading to the mold cavity defined by the mold.

4. The method of claim 1, further comprising:

using a combining valve of the combining chamber to: (i) receive the molten-metallic alloy and the foaming agent from respective injection mechanisms, the molten-metallic alloy and the foaming agent combining, at least in part, to form the molten-metallic alloy and the foaming agent in the combining valve, and (ii) transmit the molten-metallic alloy and the foaming agent to a shooting pot;

using the combining valve to: (i) not receive the molten-metallic alloy and the foaming agent from the respective injection mechanisms, and (ii) permit the shooting pot to shoot the molten-metallic alloy and the foaming agent back into the combining valve; and using a conduit to communicate the molten-metallic alloy and the foaming agent, under pressure, from the combining valve to the mold gate, the mold gate leads to the mold cavity defined by the mold.

5. The method of claim 1, further comprising:

using a combining valve of the combining chamber to: (i) receive the molten-metallic alloy and the foaming agent from respective injection mechanisms, the molten-metallic alloy and the foaming agent and combining, at least in part, in the combining valve, and (ii) communicate the molten-metallic alloy and the foaming agent to the mold gate leading to the mold cavity defined by the mold.

6. The method of claim 1, further comprising:

using a hot runner of the combining chamber, the hot runner including a manifold having: switching valves, (ii) shooting pots, and (iii) a combining valve;

coupling the switching valves to respective injection mechanisms so as to receive the molten-metallic alloy and the foaming agent from the respective injection mechanisms;

coupling the shooting pots to the switching valves respectively; and coupling the combining valve to the shooting pots and also to the mold gate leading to the mold cavity defined by the mold.

7. The method of claim 6, further comprising:

filling pressure chambers of the shooting pots with a pressurizable fluid; and slidably moving pistons of the shooting pots between the pressure chambers respectively and accumulation chambers of the shooting pots respectively.

8. The method of claim 7, further comprising:

using, once the combining valve is placed in a non-flow state and the switching valves are placed in a flow state, the respective injection mechanisms to inject the molten-metallic alloy and the foaming agent respectively into the accumulation chambers of the shooting pots respectively; and moving the pistons into the pressure chambers respectively so as to displace the pressurizable fluid out from the pressure chambers.

9. The method of claim 7, further comprising:

pressurizing, once the switching valves are placed in a non-flow state, the combining valve is placed in a flow state, the pressure chambers;

moving the pistons into the accumulation chambers respectively so as to inject or push the molten-metallic alloy and the foaming agent respectively into the combining valve, and the molten-metallic alloy and the foaming agent become combined, at least in part in the combining valve; and pushing the molten-metallic alloy and the foaming agent under pressure into the mold gate.

10. The method of claim 1, further comprising:

using a hot runner of the combining chamber, the hot runner including a manifold having: (i) shooting pots and (iii) a combining valve;

coupling the shooting pots to respective injection mechanisms so as to receive the molten-metallic alloy and the foaming agent from the respective injection mechanisms;

coupling the combining valve to the shooting pots; and coupling the combining valve to the mold gate leading to the mold cavity defined by the mold.

11. The method of claim 10, further comprising:

filling pressure chambers of the shooting pots with a pressurizable fluid; and slidably moving pistons of the shooting pots between the pressure chambers and accumulation chambers of the shooting pots.

12. The method of claim 11, wherein:

using, once the combining valve is placed in a non-flow state, the respective injection mechanisms to accumulate and then to inject the molten-metallic alloy and the foaming agent respectively into the accumulation chambers.

13. The method of claim 11, wherein:

using, once the molten-metallic alloy and the foaming agent are received into the accumulation chambers respectively, screws of the respective injection mechanisms to maintain their positions so as to prevent flow of the molten-metallic alloy and the foaming agent back into the respective injection mechanisms; and pressuring, once the combining valve is placed in a flow state, the pressure chambers so as to move the pistons into the accumulation chambers respectively so as to inject the molten-metallic alloy and the foaming agent respectively from the accumulation chambers into the combining valve.

14. The method of claim 1, further comprising:

using a hot runner of the combining chamber, the hot runner including a manifold having: (i) a combining valve and (ii) nozzles;

coupling the combining valve to injection mechanisms;

coupling the nozzles to the combining valve; and coupling the nozzles to respective mold gates leading to mold cavities defined by a mold body of the mold, and in operation, the molten-metallic alloy and the foaming agent combine, at least in part, in the combining valve and the nozzles.

* * * * *